US007329230B2

(12) United States Patent
Mazzarolo

(10) Patent No.: US 7,329,230 B2
(45) Date of Patent: Feb. 12, 2008

(54) FREELY JOINTED ARRANGEMENT FOR PROTECTING THE BACK AGAINST BUMPS

(75) Inventor: Giovanni Mazzarolo, Treviso (IT)

(73) Assignee: Alpinestars Research SRL, Treviso (IT)

( * ) Notice: Subject to any disclaimer, the term of this patent is extended or adjusted under 35 U.S.C. 154(b) by 783 days.

(21) Appl. No.: 10/757,022

(22) Filed: Jan. 14, 2004

(65) Prior Publication Data

US 2004/0193085 A1 Sep. 30, 2004

Related U.S. Application Data

(63) Continuation of application No. PCT/EP02/08463, filed on Jul. 30, 2002.

(30) Foreign Application Priority Data

Aug. 10, 2001 (IT) ..... TV2001A0113

(51) Int. Cl.
*A61F 13/00* (2006.01)
*A41D 13/00* (2006.01)

(52) U.S. Cl. ..... 602/19; 128/846; 2/467; 2/455

(58) Field of Classification Search ..... D29/100; 602/19; 128/846; 2/92, 455, 467, 44
See application file for complete search history.

(56) References Cited

U.S. PATENT DOCUMENTS 5,140,995 A * 8/1992 Uhl ..... 128/846
5,328,447 A * 7/1994 Kapounek et al. ..... 602/19
5,400,801 A * 3/1995 Archer, III ..... 128/846
5,402,742 A 4/1995 Kiaulehn
5,768,717 A * 6/1998 Le Sueur ..... 2/467
6,687,920 B2 * 2/2004 Berns ..... 2/467
6,852,087 B1 * 2/2005 Dainese ..... 602/19

FOREIGN PATENT DOCUMENTS

| | | |
|---|---|---|
| DE | 34 41 876 C2 | 5/1985 |
| DE | 195 27 036 A1 | 1/1997 |
| DE | 196 01 151 A1 | 7/1997 |
| FR | 2676178 | 11/1992 |
| GB | 2 328 859 | 3/1999 |
| WO | 99/04661 | 2/1999 |

* cited by examiner

*Primary Examiner*—Kim M Lewis
(74) *Attorney, Agent, or Firm*—Katten Muchin Rosenman LLP

(57) ABSTRACT

An arrangement for protecting the back against bumps, comprising a shield and a plurality of plates, which are linked with each other and fastened on to the shield. Each plate overlaps by an extent corresponding to approximately half of its length the adjacent plate and is kept jointed together with all other plates by a connection element which extends along the longitudinal axis of the arrangement and is provided with integral means for connecting with the various plates so as to enable each plate to rotate to a limited extent, but freely in all directions.

10 Claims, 6 Drawing Sheets

FREELY JOINTED ARRANGEMENT FOR PROTECTING THE BACK AGAINST BUMPS

CROSS-REFERENCE TO RELATED APPLICATIONS

This is a continuation of International Application PCT/EP02/08463 filed Jul. 30, 2002.

FIELD OF THE INVENTION

The present invention refers to an arrangement for protecting the back of a person against impacts and bumps, in particular, although not solely those impacts and bumps that may be incurred when falling during the practice of a sports activity, such as for instance downhill skiing, motor-cycling, cycle racing, sleighing and the like, which involves moving at even very high speeds, while failing to provide for the use of external guarding or protection structures (cockpits, cabins, canopies or the like).

BACKGROUND OF THE INVENTION

The patent application WO-A-99 04661 deals with the risks that may be incurred in these circumstances and, to this purpose, discloses a protection arrangement that is intended to be fastened on to the back of the user by means of braces, straps, belts or the like, in which such an arrangement comprises two supports which are aligned vertically with and joined to each other by means of a hinging button extending perpendicularly to the spine. Both supports are constituted on the outer side by a plurality of substantially rigid plates featuring a honeycomb structure, and on the inner side (i.e. in contact with the user's back) by a continuous layer of foam material, as well as by a continuous intermediate layer of soft material capable of absorbing that share or portion of impact-induced energy that fails to be absorbed by a permanent deformation of the honeycomb structure. In each one of said two supports, the plates are connected to each other by means of book-like hinges, whose axis extends in a direction that is perpendicular to the longitudinal axis of the protection arrangement, this axis being practically coincident with the spine of the user, so as to be able to compliantly follow the curvature of the same spine without any discontinuity being created between a plate and the next one.

This prior-art protection arrangement, however, is not effective in solving the totality of the above-mentioned problems, since:

a) the honeycomb structure of the plates is effective in taking up through its own deformation solely those blows that are directed perpendicularly to the plates themselves;

b) owing to the permanent deformation of the plates, the protection arrangement becomes unserviceable upon receiving just a single bump or impact;

c) its effectiveness is anyway restricted owing to both the fact that the rotation about the axis of the hinges is the sole degree of freedom of the plates with respect to each other in each one of the two supports is, and the fact that, along the however narrow strips formed by the same hinges, there is no honeycomb reinforcement available;

d) in the case of a bump imparted or suffered exactly in correspondence of the hinging button between the two supports, which practically comes to lie at the level of the lumbar vertebrae, the possibility exists for the same button, which has a definitely small cross-section area, to exert on to the back of the user a localized pressure (compression) that may be quite high.

U.S. Pat. No. 5,140,995 discloses a protective device consisting of many identical plates, made of deformable plastic material, which are positioned one behind the other in a longitudinal direction of the spinal column, in a limited overlapping relationship. There is no possibility for each of the plates to freely rotate with respect to the others in consideration that they are individually connected to an underlying flexible shield by means of rivets at the four corners thereof. As a consequence the protection afforded by the device is restricted to a rather limited range of directions of the impact bump. Moreover, the plates have a width which is substantially limited to the vertebrae and do not ensure a protection to other parts of the skeleton, such as the ribs of the chest.

Also FR 2,676,178 discloses a protection device consisting of various arched plates, made of deformable plastic material, which are positioned one behind the other, with a certain overlapping, above a common flexible sheet to which they are fixedly connected in correspondence of zones at the sides of the spinal column. In this case the plates are sufficiently wide to protect also the ribs but the distribution of the impact force to the adjacent plates is permitted by flexible rods which does not ensure a firm, though localized, interconnection of the plates.

GB 2,328,859 discloses several devices which comprise a flexible sleeve to be worn about against the various parts of the body to be protected, including the chest. The devices make use of rigid plates which are interconnected in overlapping relationship and attached to the sleeve in such a way to have only a limited relative movement.

DE 195 27 036 discloses a protection device for the spinal column consisting of various plates which are positioned one behind the other in a partially overlapping relationship and are interconnected by at least one longitudinally aligned connection element having the purpose of preventive a mutual sliding of the plates. The protection afforded by this device is quite low in case of severe impacts in consideration of the flatness of the plates and relies entirely on the shock-absorbing nature of the material (preferably plastic foam) with which the plates are made.

Also the device disclosed by DE 196 01 151 does only rely its protecting action on the shock-absorbing nature of the material (preferably plastic foam) with which its plates are made.

The protective device disclosed by U.S. Pat. No. 5,402,742 is only restricted to the lumbar area of the spinal column and makes use, among other, of T-shaped elements of plastic interlocking with one another and fastened to a back part by rivets inserted at the four corners of the transversal arm. The elements have only a limited flexibility.

At last, the protective device disclosed by U.S. Pat. No. 5,328,447 comprises a plurality of upper support members having a convexity in correspondence of the spinal column. Each of said upper members fits over a pair of lower members in mating relationship and makes use of fastening means which only permit a mutual rotation along the longitudinal direction of the spinal column.

SUMMARY OF THE INVENTION

It is therefore a main object of the present invention to provide a protection arrangement which does not feature any of the above mentioned criticalities and drawbacks, and is at the same time capable of effectively safeguarding the user even in the case of particularly violent bumps concentrated on any point whatsoever of the user's back and imparted in any direction whatsoever. A protection arrangement incorporating the characteristics as recited and defined in the appended claims enables this and further aims to be reached, as this will be confirmed by the description that is given below by way of non-limiting example of a preferred, although not sole embodiment of the present invention with reference to the accompanying drawings.

DETAILED DESCRIPTION OF THE INVENTION

Figure 1:
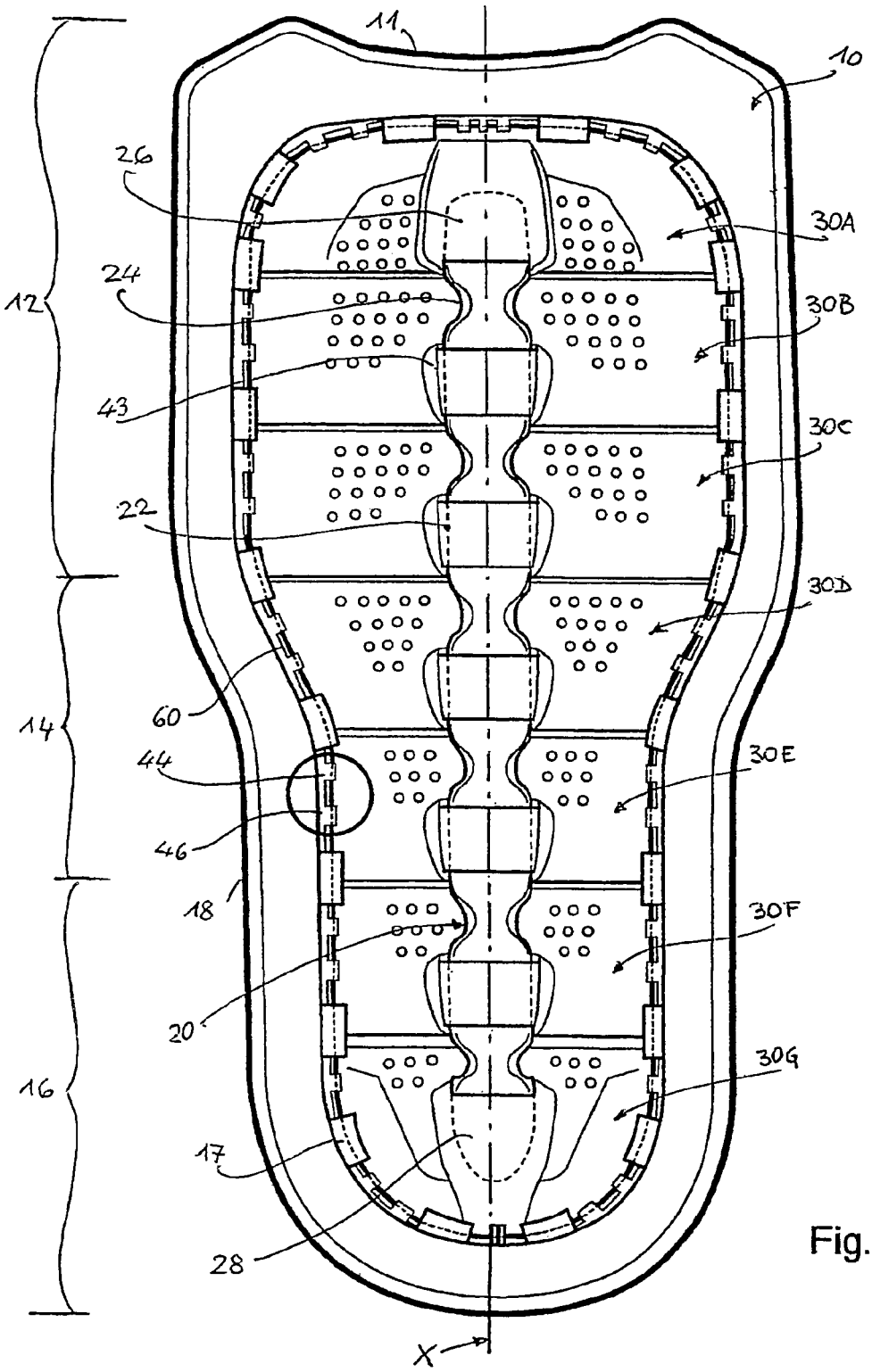
FIG. 1 is a front view from the outside of the protection arrangement according to the present invention.

As illustrated in FIG. 1, a protection arrangement according to the present invention is substantially constituted by a thin shield, which is generally indicated at 10, and a plurality of plates which are attached to the outwards facing face of the shield. These plates as a whole are generally indicated at 30 and the related assembly is obtained through the use of a connection element 20 extending along the longitudinal axis X of the arrangement. The shield 10 is made of a transpiring, flexible and abrasion-resistant material, such as for instance natural or synthetic leather or the like, and has a peripheral edge of an elongated, downwards tapered shape. Although being integrally made as a single piece, the shield 10 has an upper part 12, which extends from the cross-line 11, positioned at the level of the lower cervical vertebrae, down to almost halfway the thoracic vertebrae, an intermediate part 14 at the level of the lowest thoracic vertebrae and the uppermost lumbar vertebrae, and a lower part 16 extending down to the coccyx. Suitable fastening means, such as straps, belts and/or braces (not shown), enable the shield 10 to be fastened to the user's body, upon the back thereof.

Figure 2:
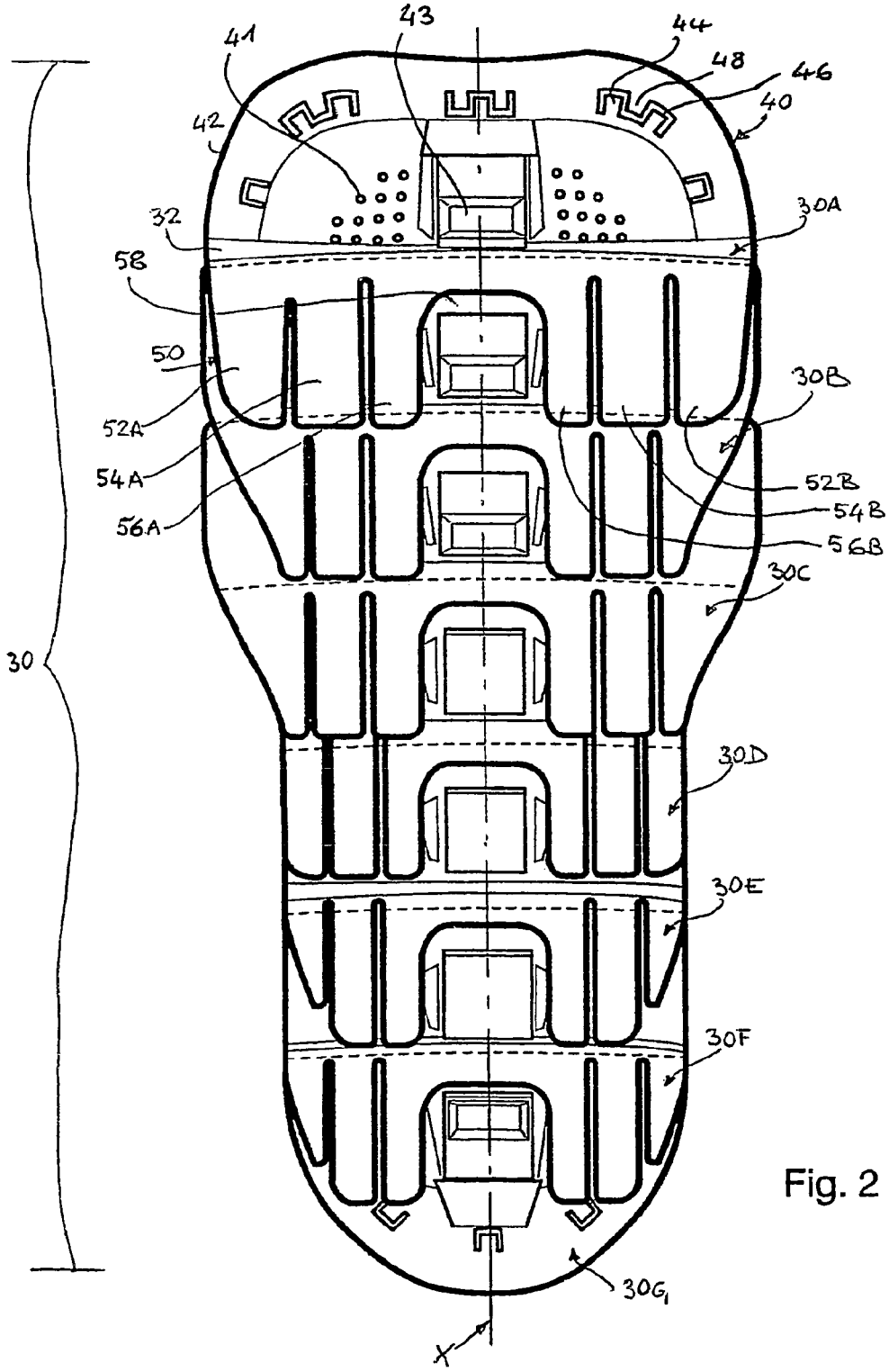
FIG. 2 is a front view from the side in contact with the user's back that only shows the assembly of the structural parts of the arrangement.
Figure 3:
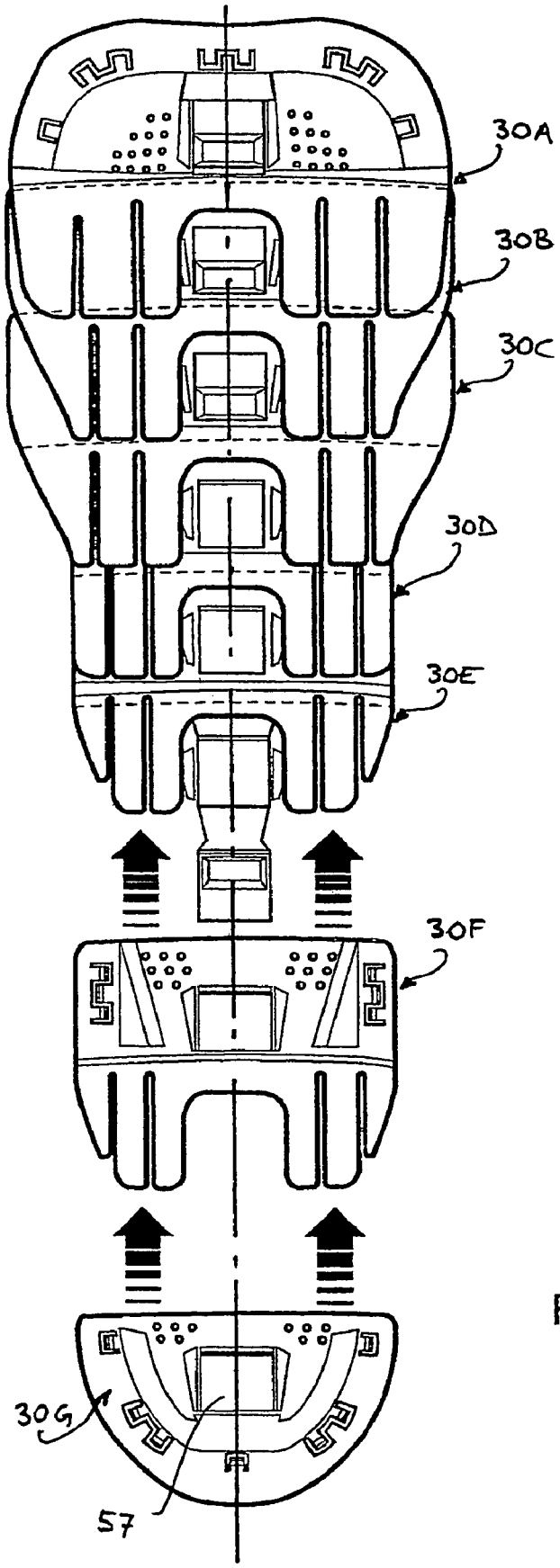
FIG. 3 is a similar view to FIG. 2, however showing some of said structural parts separated from the other ones, and furthermore the element that holds them joined with each other into an assembly.
Figure 4:
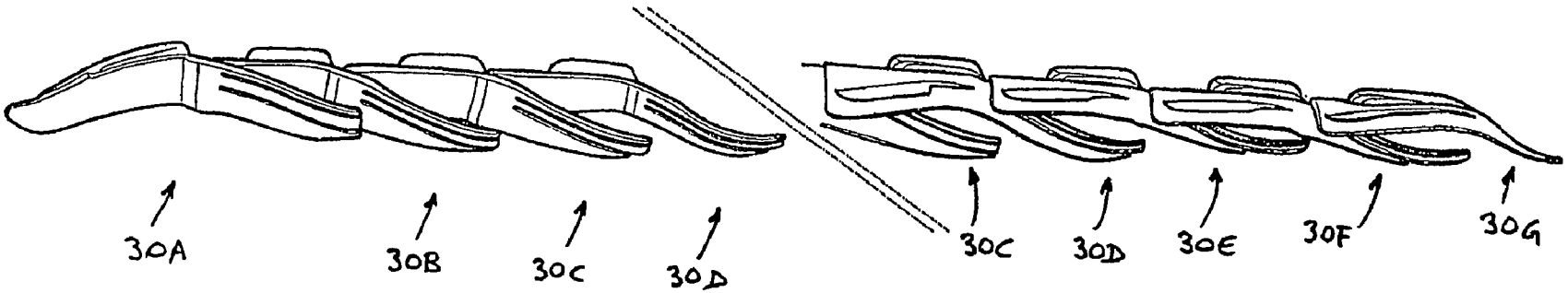
FIG. 4 illustrates the same structural parts of FIGS. 2 and 3 in two side views taken at different angles with respect to the longitudinal axis of the protection arrangement.

The above-cited plates, which are the actual structural parts of the protection arrangement, are made of a mouldable, impact-resistant thermoplastic material, such as for instance polyethylene or polyurethane. With reference also to FIGS. 2 to 4 and considered in a vertical direction, the three upper plates 30A, 30B and 30C are positioned onto the upper part 12, above two intermediate plates 30D and 30E positioned on the intermediate part 14 above the two lower plates 30F and 30G that are in turn positioned on the lower part 16 of the shield 10, while all said plates are situated at a certain distance from the peripheral edge 18 of the shield. Consistently with the shape of said shield, the uppermost plates are larger in their width than the intermediate and the lowermost plates. All plates, except for the lowermost plate 30G, have on the contrary the same height as measured along the axis X.

Figure 5:
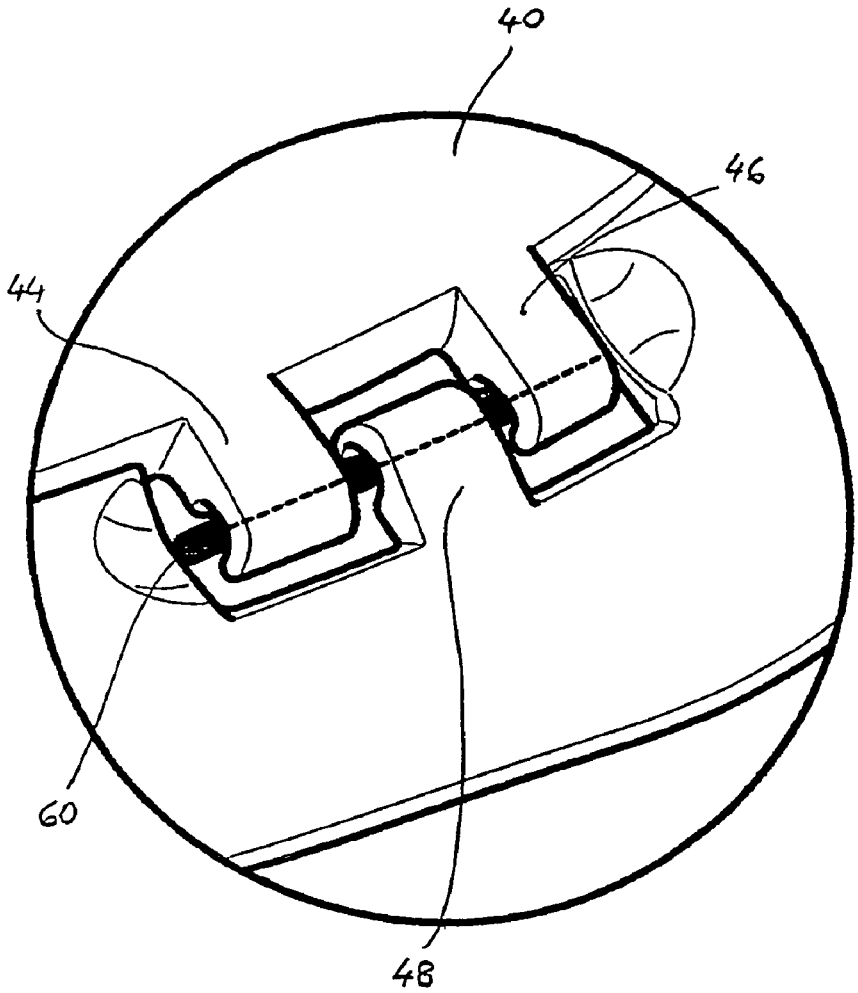
FIGS. 5 and 6 are enlarged-scale front and rear views, respectively, of the details that are enclosed in a circle in FIG. 1.
Figure 6:
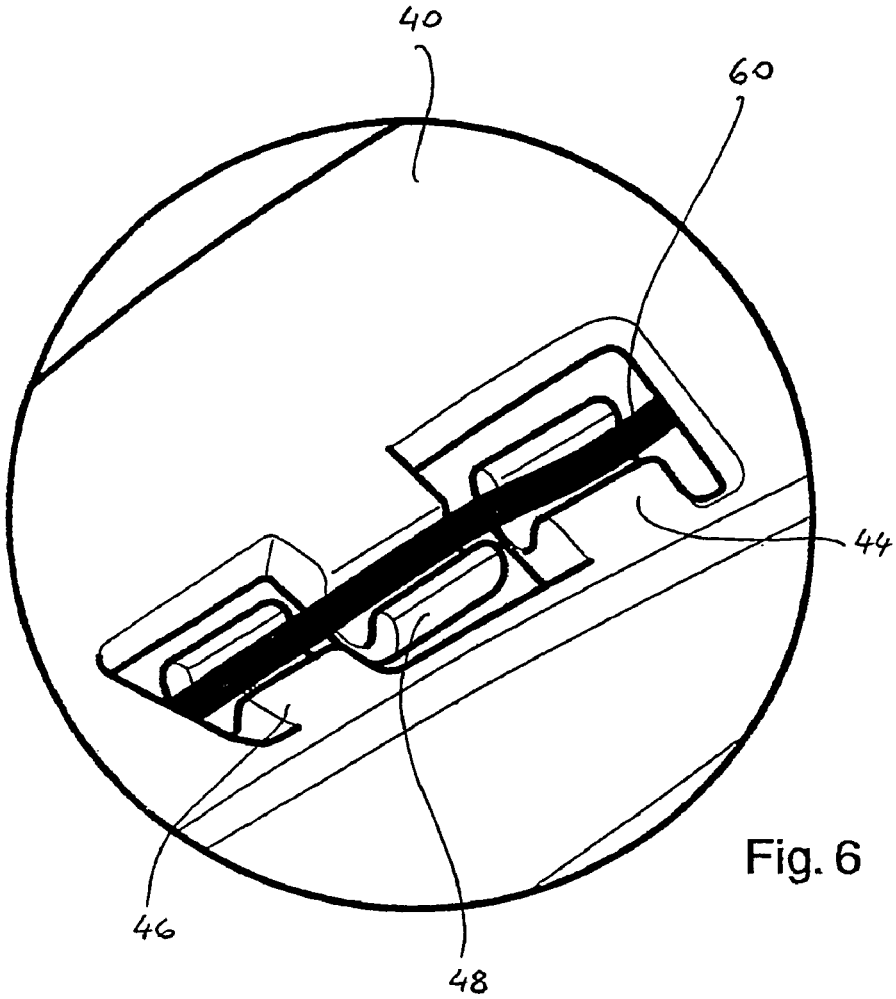

Since the general configuration is substantially the same for the plates 30A, . . . , 30F, only the uppermost plate indicated at 30A, which is also the one illustrated in greater detail in the accompanying drawing, shall be described here for reasons of greater simplicity. The plate 30A is concave in its shape on the side of the shield 10, i.e. on the side facing the back of the user, both in the direction parallel to the longitudinal axis X of the protection arrangement, as this is best illustrated by the double representation appearing in FIG. 4, and transversally with respect to the same axis. In fact, the plate consists of an upper half 40 and a lower half 50, which are separated from each other by a cross rib 32 where concavity is at its maximum. The upper half 40 of the plate 30A is substantially continuous, except for some sets of three hooks, distributed all along the outer edge 42 and open in face of the shield 10. In each such set of three hooks, the two lateral hooks 44 and 46 are oriented towards the longitudinal axis X (see also FIG. 5), whereas the central hook 48 is oriented towards said outer edge 42 (see also FIG. 6). In this way, in the various sets of three hooks there is retained a twine 60 that extends all along the shield 10, obviously at a certain distance from the peripheral edge 18 thereof, and, as it passes under a plurality of loops 17 attached to the outer surface of the shield 10, enables the plate assembly 30 to be secured to the same shield 10. On the upper half 40 of the plate there are provided aeration and lightening holes 41, as well as a tapered receptacle 43 for the snap engagement of the already mentioned longitudinal connection element 20. This element substantially consists of a kind of belt (which is made of mouldable and impact-resistant thermoplastic material as well) in which, along the axis X, broader portions 22, which are adapted to snap-fit into engagement with the various plates, alternate with narrower portions 24, and terminates with two broad portions 26, 28 that have a shape differing from the one of the above cited portions 22 (see FIGS. 1 and 3).

Figure 7:
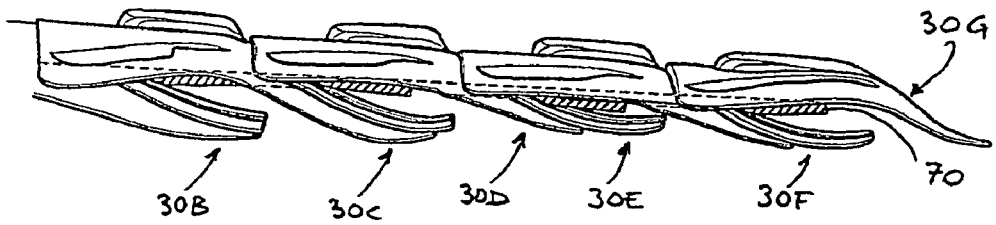
FIG. 7 is a variant of FIG. 4 illustrating, further to some of the already mentioned structural parts of the protection arrangement, also other parts made of a softer material.

The lower half 50 of the plate 30A is constituted, symmetrically to the axis X, by two sets of three thin tongues 52A, 52B, 54A, 54B, 56A, 56B, which extend downwards in a cantilever manner starting from the cross rib 32 separating the two halves 40 and 50 from each other. The two sets of three tongues are furthermore separated from each other by a recess 58 which is somewhat wider than the tapered receptacles 43 provided on the first half 40 of the said plate. The plate 30G, which is provided in the lowermost position, does not comprise any tongue, but features, further to aeration and lightening holes 41 and to sets of three hooks (as illustrated earlier in this description) a tapered receptacle 57 for the lowest end portion 28 of the longitudinal connection element 20, see FIG. 3, which illustrates how the various plates 30A, . . . , 30G are assembled together. The tongues 52A, . . ., 56B of any plate come to lie underneath the upper half 40 of the subsequent plate and increasingly spaced from the latter as one moves away from the rib 32 towards their free end portion, as this is also illustrated in FIGS. 4 and 7. It therefore ensues that all over the height of the plate assembly 30, except for the upper half of the plate 30A situated in the uppermost position, there are two overlapping plates that are spaced from each other with the possibility of moving in all directions with respect to each other. FIG. 7 further shows that it is optionally possible for a thermoformed or punched strip 70 of a soft material, such as for instance a plastic foam, to be arranged between the plates, in a position that is closer to the longitudinal connection element 20 than the shield 10, so as to be able to cooperate with the plates in taking up the impact bump without undergoing any permanent deformation. The protection arrangement may be completed by an envelope (not shown), performing solely as a covering, to be secured to the shield 10 at a point above the plate assembly 30.

In operation the above described protection arrangement displays the following features. The longitudinal connection element 20 enables each one of the various plates to rotate freely (albeit with an obviously limited travel range) in all directions relative to the other plates. This is why it is considered appropriate to define the protection arrangement according to the present invention as being freely jointed, also in consideration that each plate is also capable of deforming elastically independently of the other plates.

The advantages offered by the present invention are therefore not just limited to the fact that said rotations of the plates with respect to each other enable the protection arrangement to most compliantly follow the curvature of the user's back, but also, and above all, the fact that the arrangement is fully capable of taking up each and any impact or bump that the user may be imparted as a consequence of an accidental fall. In fact, whichever the direction of the imparted impact may be with respect to the axis X, one or more of the tongues of the lower half of at least one of the plates will undergo an elastic deformation, i.e. a non-permanent deformation (namely, a deflection about the cross rib 32, which tends to nullify the natural concavity of the plate), much in the same way as a leaf spring works in a motor vehicle. According to the direction of an impact, a plate can alternatively, or even simultaneously, rotate in all directions with respect to the other plates of the protection arrangement. In all cases the risk is effectively avoided that the energy due to the impact deriving from the user bumping against an obstacle may discharge itself on to the back of the user. At the same time, the user is ensured the most effective and complete protection even without a functional intervention of the strip 70 of soft material, which is anyway to be considered as an optional provision. Such functionality is of course definitely superior with respect to the one ensured by the prior-art protection arrangement that has been described earlier in this description.

Although the above description refers to a currently preferred embodiment of the present invention, it will be appreciated that a number of further embodiments may be developed without departing from the scope of the present invention as defined by the appended claims.

I claim:

1. An arrangement for protecting the back against bumps, comprising:

an elongated shield adapted to extend from the lower cervical vertebrae down to the coccyx of the wearer and provided with means for fastening said shield onto the wearer's body and an assembly of plates that are made of mouldable and impact-resistant plastic material, positioned on an outwards oriented face of the shield and linked with each other in an overlapping relationship by an extent corresponding to approximately half of their length in the direction of a longitudinal axis of the arrangement by a connection element that extends along said longitudinal axis, said assembly being fastened onto the shield;

wherein said connection element is made of mouldable and impact-resistant plastic material and integrally comprises portions which are adapted to be in engagement with corresponding seats provided on the plates to enable said plates to rotate to a limited extent, but freely in all directions.

2. An arrangement according to claim 1, wherein said connection element comprises an alternate sequence of broader portions, which are adapted to snap-fit into engagement with the corresponding seats provided on the plates, and narrower portions.

3. An arrangement according to claim 1, wherein all plates, except for the lowermost plate relative to the longitudinal axis of the arrangement, are concave on their side facing the shield so as to comprise an upper half, a lower half and a cross rib perpendicular to the longitudinal axis of the arrangement and separating said upper and lower halves in correspondence of the line of deepest concavity of each plate, said lower half of said plates substantially consists of a plurality of tongues protruding in a cantilever manner from said cross rib and increasingly spaced from the upper half of an adjacent plate as the distance from said cross rib increases.

4. An arrangement according to claim 3, wherein all of the plates are provided with aeration and lightening holes on their upper halves.

5. An arrangement according to claim 3, wherein all of the plates are provided with a plurality of hooking means distributed along an edge thereof for fastening the plate assembly to an outwards oriented face of the shield.

6. An arrangement according to claim 5, wherein said means for fastening the plate assembly onto the shield consist of a flexible element.

7. An arrangement according to claim 6, wherein said flexible element comprises twine.

8. An arrangement according to claim 1, further comprising a flat element made of soft material disposed between the plates in a position that is closer to the connection element than the shield.

9. An arrangement according to claim 1, further comprising a protective envelope provided above the assembly of plates and adapted to perform as a covering.

10. An arrangement according to claim 1, wherein the shield is made of a transpiring, flexible and abrasion-resistant material.

* * * * *